United States Patent [19]

Hjortnäs

[11] Patent Number: 4,602,750

[45] Date of Patent: Jul. 29, 1986

[54] DEVICE FOR INHERENTLY ADJUSTING PAPER TRANSPORT MODES FOR ROLLED OR SEPARATED OUTPUT

[75] Inventor: Erik R. Hjortnäs, Järfälla, Sweden

[73] Assignee: U.S. Philips Corporation, New York, N.Y.

[21] Appl. No.: 705,764

[22] Filed: Feb. 26, 1985

[30] Foreign Application Priority Data

Mar. 1, 1984 [SE] Sweden ..... 8401147

[51] Int. Cl.[4] ..... B65H 18/10; B65H 20/02

[52] U.S. Cl. ..... 242/67.2; 226/188; 400/586; 400/605

[58] Field of Search ..... 226/188; 400/586, 587, 400/588, 589, 590, 591, 592, 593, 594, 605, 607; 242/67.2, 67.1 R, 67.3 R, 55, 75.5, 67.5

[56] References Cited

U.S. PATENT DOCUMENTS

| | | | |
|---|---|---|---|
| 1,113,227 | 10/1914 | Lundeberg | 400/586 |
| 1,208,757 | 12/1916 | Dennis | 400/588 |
| 2,034,543 | 3/1936 | Twiss et al. | 242/67.2 |
| 2,510,626 | 6/1950 | Geisheck | 400/605 |
| 3,315,860 | 4/1967 | Adams et al. | 226/188 X |
| 3,338,488 | 8/1967 | Hunt | 242/67.2 X |
| 3,710,343 | 1/1973 | Bauer | 242/67.2 X |
| 3,902,418 | 9/1975 | Morishita | 400/586 X |
| 3,934,835 | 1/1976 | Maxwell | 242/67.2 |
| 3,989,201 | 11/1976 | Cottrell | 242/75.5 |
| 4,434,950 | 3/1984 | Nunnerich et al. | 242/67.2 |

FOREIGN PATENT DOCUMENTS 0002796 11/1979 European Pat. Off. .

*Primary Examiner*—Stanley N. Gilreath
*Attorney, Agent, or Firm*—David R. Treacy

[57] ABSTRACT

A strip, such as paper in a printing mechanism, is transported over a friction roll either along a first path, in which the paper is driven by rotation of the friction roll by a drive motor through an overrunning clutch; or along a second path in which the paper passes over the friction roll and is taken up on a take-up roll, the pull of the strip onto the take-up roll causing the friction roll to rotate faster and disengaging the clutch. Two strips may be passed through a nip between the friction roll and a pressure roll. The pressure roll is driven by coupling to the friction roll so as to have a slightly higher circumferential velocity.

4 Claims, 5 Drawing Figures

DEVICE FOR INHERENTLY ADJUSTING PAPER TRANSPORT MODES FOR ROLLED OR SEPARATED OUTPUT

BACKGROUND OF THE INVENTION

The invention relates to a device for transport of a strip or strip-like information carriers in different modes of operation, wherein in a first mode of operation a receipt information carrier is transportable about a friction roll which is rotated by a drive motor via an activated clutch, while in a second mode of operation a journal information carrier is transportable about the roll which is rotated by the drive motor, the clutch being deactivated in the second mode of operation.

In a known transport device of the kind mentioned in the opening paragraph (see published European Patent Application No. 0002796) a manually operated clutch is activated for the first mode of operation wherein a receipt information carrier has to be transported. The clutch is manually deactivated for transport of the journal information carrier in the second mode of operation. A disadvantage of the known device is that for a change of operation mode not only a different information carrier has to be inserted but also a manual activation or deactivation of the clutch has to be carried out. A charge of operation mode means therefore a relatively cumbrous sequence of manipulations.

SUMMARY OF THE INVENTION

The invention has for its object to provide a device for transport of strip-like information carriers wherein a change of operation mode requires the simple insertion of the information carriers only.

A device according to the invention is for this purpose characterized in that the clutch is an overrunning clutch having first and second relatively rotatable parts. The first part is coupled to the drive motor and the second part is coupled to the friction roll, the first and second parts being engageable to and disengageable from each other by reversal of the relative rotation between them. In the first mode of operation the first and second part of the clutch are engaged, while in the second mode of operation these parts are disengaged by pulling the journal information carrier, which is coupled to a take-up or drive roll driven by the same motor, at a speed higher than that corresponding to the rotation of the first clutch part.

A preferred embodiment of the invention, wherein by means of a third mode of operation two strips or information carriers may be transported in combination, is further characterized in that in the third mode of operation the receipt information carrier and the journal information carrier are both transportable about the friction roll by pulling the journal information carrier which is coupled to the drive roll, while the clutch is deactivated.

A still further preferred embodiment of the invention, in which different drive conditions of the receipt and journal information carrier are compensated for, is characterized in that the friction roll cooperates with a pressure roll, the receipt information carrier and the journal information carrier passing through the nip between the pressure and friction rolls, and the receipt information carrier being transported as a result of the friction between the rolls and the carriers. In this embodiment the pressure roll in rotated with a circumferential velocity which is greater than the circumferential velocity of the friction roll.

BRIEF DESCRIPTION OF THE DRAWING

The invention will be described in more detail with reference to the accompanying drawing.

DESCRIPTION OF THE PREFERRED EMBODIMENT

Figure 1:
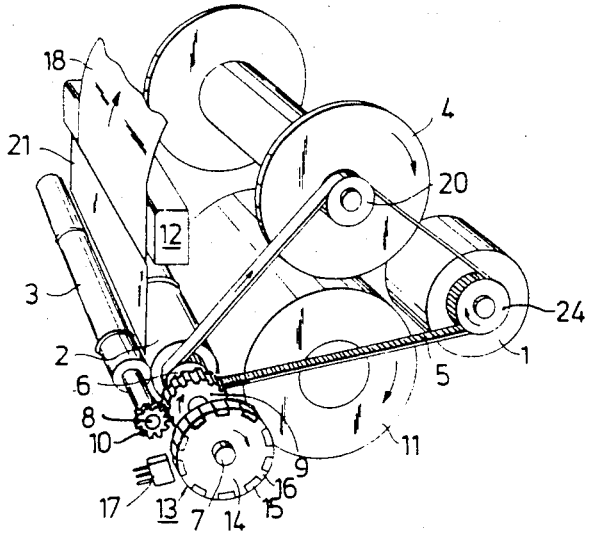
FIG. 1 is a perspective view of a device for transport of a receipt information carrier.
Figure 2:
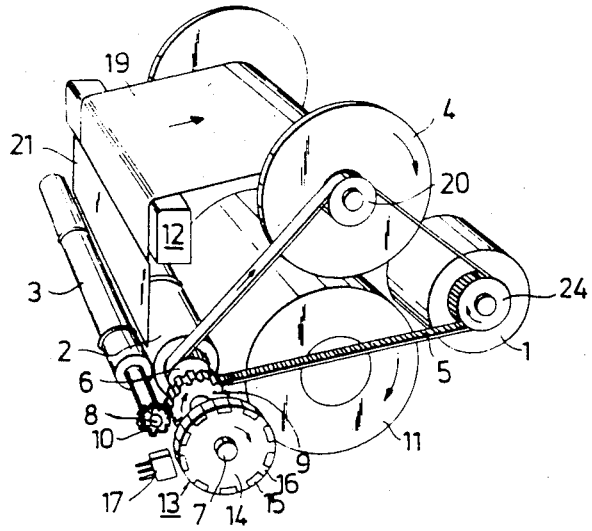
FIG. 2 is a perspective view of a device for transport of a journal information carrier.
Figure 3:
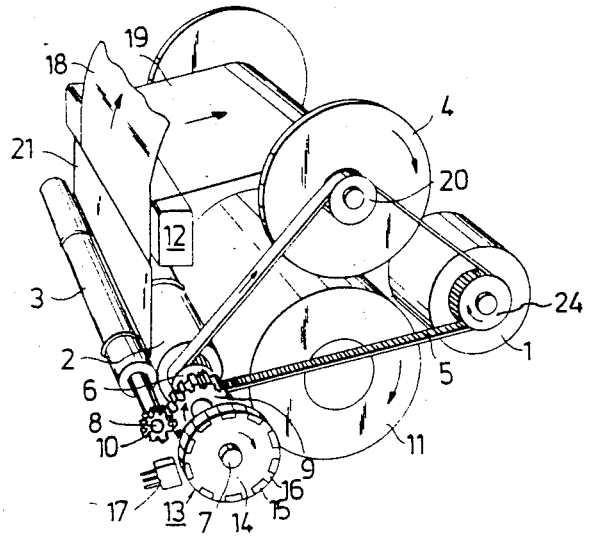
FIG. 3 is a perspective view of a device for transport of both a receipt information carrier and a journal information carrier, FIG. 4 schematically shows the friction roll provided with a clutch.

The device for transport of information carriers shown in FIGS. 1–3 comprises a drive motor 1, a friction roll 2, a pressure roll 3 and a take-up or drive roll 4. The friction roll 2 is provided with an overrunning clutch 6 comprising first and second relatively rotatable parts (22, 23, in FIG. 4 or 5). The first part 22 is coupled to the drive motor via a driving belt 5. In order to get a strong coupling between the first part 22 of the clutch and the driving belt 5 and between the driving belt 5 and a pulley 24 on the shaft of the drive motor 1, the driving belt and the cooperating sections of the first part 22 of the clutch and the pulley are toothed. The second part 23 (FIGS. 4–5) of the clutch 6 is connected to the shaft 7 of the friction roll 2. The pressure roll 3 is journaled in pivotable arms (not shown) which are spring loaded against the friction roll 2. The shaft 7 of the friction roll 2 and the shaft 8 of the pressure roll 3 are each provided with a respective gear wheel 9, 10 which together forming a gear coupling (gear reduction set) between the shaft 8 of the pressure roll 3 and the shaft 7 of the friction roll 2. The gear ratio of the gear reduction set is so chosen that the circumferential velocity of the pressure roll 3 is somewhat higher than the circumferential velocity of the friction roll 2. This overfeed of the pressure roll 3 is of particular importance in a device for transport of both a receipt information carrier and a journal information carrier which will be explained in more detail below. When the radius of the friction roll 2 is greater than the radius of the pressure roll 3, as shown in the FIGS. 1–3, the radius of the gear wheel 9 to a certain extent must be greater than the radius of the gear wheel 10 of the gear reduction set to obtain the desired circumferential velocities. In addition to the driving of the first part 22 of the clutch the drive motor drives the drive roll 4 via the same driving belt 5.

In the case shown in FIG. 1 concerning a transport of the receipt information carrier 18 only (first mode of operation), the device is loaded by means of unwinding a one-layer paper, the carrier, from a paper supply roll 11, and then guiding the paper between the friction roll 2 and the pressure roll 3 to a print position in front of a print bar 12. Paper guide means 21 are provided between the friction roll 2 and the print bar 12 for the guiding of the receipt information carrier 18. The drive motor 1 drives the first part of the clutch 6 via the driving belt 5, the first part 22 of the clutch 6 then being, as will be more apparent from the description below, engaged with the second part 23 of the clutch which is fixed to the shaft 7 of the friction roll 2. Simultaneously the pressure roll 3 which is spring loaded against the friction roll 2 is driven via the gear wheels 9 and 10. The pressure of the pressure roll 3 against the friction roll 2 prevents the carrier 18 being transported between the friction roll 2 and the pressure roll 3 from slipping against the friction roll 2, but due to the overfeed of the pressure roll 3 there is a small slip between the pressure roll 3 and the carrier 18. This slip has no adverse effect on the transport and correctness of length of the paper 18 transported in front of the print bar 12.

Furthermore, a line sensing device 13 encoder is provided at one end of the shaft 7 of the friction roll 2. The device 13 comprises a wheel 14 connected to the shaft 7 of the friction roll 2, the wheel being provided with alternate regions 15, 16 which will be detected by means of some form of sensing such, e.g., optical sensing. As an example, a light emitting diode in combination with a photocell disposed in a common unit 17 may be used for the detection of the regions 15,16. The line sensing device ensures that the paper (carrier) is transported intermittently or continuously in such a way that a correct line spacing is obtained. Other types of line sensing devices are previously known and may be used together with a device for transport of information carriers according to the invention. Particularly, as an example, devices making use of magnetic, capacitive or mechanical sensing may be mentioned.

When the device for transporting of strip-like information carriers is used for transport of a journal information carrier 19 only (second mode of operation), which is shown in FIG. 2, the device is loaded as in the case of transport of a receipt information carrier up to the print bar 12 with a one-layer paper, but then the paper (the strip-like carrier) is fixed to the drive roll 4. The motor 1 then drives the first part 22 of the clutch 6 and the drive roll 4 via the driving belt 5. Assuming that the first part 22 of the clutch 6 on the shaft 7 of the friction roll 2 and the pulley 20 on the shaft of the drive roll 4 have the same diameters, and that the drive roll 4 has a greater diameter than the friction roll 2, the first and the second parts of the clutch 6 are disengaged from each other when the journal information carrier 19 is wound onto the drive roll 4. At the same time 4, the journal information carrier 19 drives the pressure roll 3, which is preloaded against the friction roll 2, through the gears 9 and 10. The line sensing device 13 coupled to the friction roll 2 senses the line feeding and controls the drive motor 1 so that the feeding along the carrier is stopped at correct positions.

FIG. 3 shows the device for transporting both a journal information carrier 19 and a receipt information carrier 18 (third mode of operation). The device for transport of carriers is then loaded with a double layer paper, guided into position in front of the print bar 12 in the same way as described above. The inner paper (the journal information carrier 19) is subsequently fixed on the drive roll, while the outer paper (the receipt information carrier 18) is further guided along to a cutting device (not shown) cutting the receipt information carrier 18 at desired locations.

The first part 22 of the clutch 6 on the friction roll 2 and the pulley 20 of the drive roll 4 are driven by the motor 1 via driving belt 5. Assuming the same relative diameters of the first part 22 of the clutch 6, the pulley 20, the drive roll 4 and the friction roll 2 stated with reference to FIG. 2, the first and second parts of the overrunning clutch 6 are disengaged. When the journal information carrier 19 is wound onto the drive roll 4, the carrier drives the friction roll 2. The line sensing device 13 coupled to the friction roll 2 senses the line feeding and controls the drive motor 1 so that paper feeding is stopped at correct positions.

The outer paper (the receipt information carrier) 18 is driven by the pressure roll 3 coupled via the gear wheel 10 to the gear wheel 9 of the friction roll 2. The gear wheels 9, 10 are so dimensioned that the pressure roll 3 feeds the carrier 18 with somewhat higher circumferential velocity then the friction roll 2 feeds the carriers 19. This is possible to obtain when the following condition is fulfilled: $(r_2 \cdot r_{10})/(r_3 \cdot r_9) < 1$, in which $r_2$ is the radius of the friction roll 2, $r_3$ is the radius of the pressure roll 3, $r_9$ is the radius of the gear wheel 9 and $r_{10}$ is the radius of the gear wheel 10. When the friction between the pressure roll 3 (actually the O-shaped rings provided on the pressure roll) and the receipt information carrier 18 is greater than the friction between the surfaces of the receipt information carrier 18 and the journal information carrier 19 surfaces this gives rise to a somewhat faster feeding of the receipt information carrier 18 than the journal information carrier 19; that is, there is an overfeed of the receipt information carrier 18. Overfeed of the receipt information carrier 18 is due to the receipt information carrier 18 following a greater radius along the circumference of the friction roll 2 than the journal information carrier 19. Thus there is always a difference between the circumferential velocities of friction roll 2 and pressure roll 3.

Figure 5:
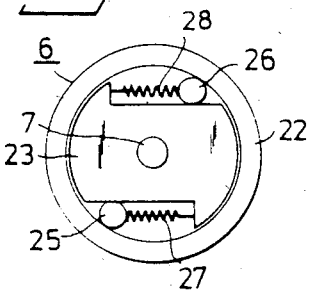
FIG. 5 is a sectional view of a clutch.
Figure 4:
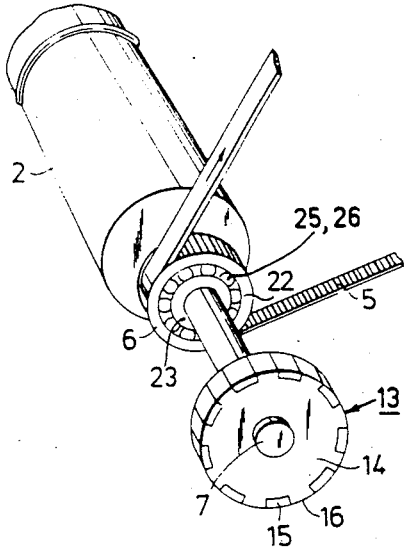

The clutch will be explained in more detail below with reference to FIGS. 4–5. The clutch consists of a part 22 and a second part 23. The first part has a circumference adapted to the toothed driving belt. The second part 23 is disposed within the first part 22 and is fixed to the shaft 7 of the friction roll 2. Further the second part 23 is provided with springs (27,28) which press against cylinder shaped elements 25 and 26. It is to be noted that the clutch according to FIG. 5 is provided with two cylinder shaped elements 25 and 26. However, as schematically indicated in FIG. 4, it is quite possible and often suitable to provide the clutch with more than two such cylinder shaped elements.

The function of the clutch 6 will now be explained. If the first part 22 of the clutch 6 is rotated in the direction indicated by the arrow on the driving belt 5 with a lower rate of rotation than the friction roll 2 is rotated in the same direction, the first and second parts of the clutch are effectively disengaged from each other. According to the above description the friction roll 2 is disengaged from the first part 22 of the clutch in the situations described with reference to FIGS. 2 and 3, in which pull on a journal information carrier 19 causes this difference in rate of rotation.

When the first part 22 of the clutch 16 is driven at a rate of rotation greater than the rate of rotation of the friction roll 2 (which is the case described with reference to FIG. 1) during transport of a receipt information carrier 18 only, the first part 22 of the clutch engages and drives the second part 23 of the clutch, which second part is fixed to the shaft 7 of the friction roll 2. Thus in the absence of a journal information carrier the friction roll 2 will be driven by the motor 1 via the driving belt 5 and the clutch 6, while the friction roll 2 is driven by the motor 1 via the drive roll 4 and the journal information carrier 19 when the device contains a journal information carrier.

It has been assumed above that the pulley 20 of the drive roll 4 and the first part 22 of the clutch 6 have the same working diameters and that the working diameter of the drive roll 4 is greater than the working diameter of the friction roll 2 in order to obtain a rate of rotation of the friction roll 2 which is greater than the rate of rotation of the first part 22 of the clutch 6. However, the same effect may be obtained if the diameters are chosen in other suitable ways. The diameter of the drive roll 4, for example, may be reduced relative to the diameter of the friction roll 2 if instead the diameter of the pulley 20 of the drive roll 4 to a corresponding degree is less than the diameter of the first part 22 of the clutch 6 on the friction roll 2.

What is claimed is:

1. A device for transporting a strip according to a mode determined by the manner of insertion of the strip, comprising:

a take-up roll, a drive motor, and first means for coupling said take up roll to said drive motor for rotating said take up roll in a take-up direction in response to operation of said motor, a friction roll, and second means for driving said friction roll in a transport direction at a given speed responsive to operation of said motor, said second means including an overrunning clutch, means for guiding an inserted strip along a first path, in a first mode of operation in which said friction roll engages the strip for transporting the strip responsive to driving of the friction roller by the motor, and means for guiding an inserted strip along a second path, in a second mode of operation in which the strip engages said friction roll and passes along a second path to and is wound around said take-up roll, said first and second driving means having ratios of take-up roll speed and given speed selected such that in the second mode of operation the strip engaging said friction roll rotates said friction roll at a speed higher than said given speed, thereby disengaging said overrunning clutch.

2. A device as claimed in claim 1, characterized by being arranged for operation in a third mode of operation in which a first strip is guided along said first path, and a second strip is guided along said second path onto said take-up roll, said second strip passing between said first strip and said friction roll, said device including means for transporting said first strip responsive to rotation of said take-up roll by said second strip.

3. A device for transporting a strip according to a mode determined by the manner of insertion of the strip, comprising:

a take-up roll, a drive motor, and first means for coupling said take up roll to said drive motor for rotating said take up roll in a take-up direction in response to operation of said motor, a friction roll; a pressure roll, and means for rotatably mounting said pressure roll for pressing against said friction roll, and permitting a strip to be guided therebetween; and second means for driving said friction roll in a transport direction at a given speed responsive to operation of said motor, said second means including an overrunning clutch, means for guiding an inserted strip along a first path, in a first mode of operation in which said friction roll engages the strip for transporting the strip responsive to driving of the friction roller by the motor, and means for guiding an inserted strip along a second path, in a second mode of operation in which the strip engages said friction roll and passes along a second path to and is wound around said take-up roll, said first and second driving means having ratios of take-up roll speed and given speed selected such that in the second mode of operation the strip engaging said friction roll rotates said friction roll at a speed higher than said given speed, thereby disengaging said overrunning clutch.

4. A device as claimed in claim 3, comprising third drive means for coupling said pressure roll to said friction roll, arranged such that said pressure roll has a circumferential velocity which is greater than the circumferential velocity of the friction roll.

* * * * *